US009640171B2

(12) United States Patent
Robertson

(10) Patent No.: US 9,640,171 B2
(45) Date of Patent: May 2, 2017

(54) ACOUSTIC LENS USING EXTRAORDINARY ACOUSTIC TRANSMISSION

(71) Applicant: William M. Robertson, Murfreesboro, TN (US)

(72) Inventor: William M. Robertson, Murfreesboro, TN (US)

( * ) Notice: Subject to any disclaimer, the term of this patent is extended or adjusted under 35 U.S.C. 154(b) by 0 days.

(21) Appl. No.: 14/739,993

(22) Filed: Jun. 15, 2015

(65) Prior Publication Data

US 2016/0111080 A1 Apr. 21, 2016

Related U.S. Application Data

(60) Provisional application No. 62/012,376, filed on Jun. 15, 2014.

(51) Int. Cl.

| | |
|---|---|
| ***G10K 11/30*** | (2006.01) |
| ***G10K 11/32*** | (2006.01) |
| ***G10K 11/04*** | (2006.01) |

(52) U.S. Cl.

CPC ..... *G10K 11/30* (2013.01); *G10K 11/04* (2013.01); *G10K 11/32* (2013.01)

(58) Field of Classification Search

CPC ..... G10K 11/30; G10K 11/32
USPC ..... 181/176, 292
See application file for complete search history.

(56) References Cited

U.S. PATENT DOCUMENTS

| | | | | |
|---|---|---|---|---|
| 8,616,329 | B1 * | 12/2013 | Welter | G10K 11/30 181/167 |
| 2003/0098200 | A1 * | 5/2003 | Clark | F24F 13/02 181/292 |
| 2012/0090916 | A1 * | 4/2012 | Berker | B32B 5/18 181/292 |
| 2012/0327744 | A1 * | 12/2012 | Lemoult | B82Y 20/00 367/99 |
| 2013/0330247 | A1 * | 12/2013 | Wilson | B01L 3/502707 422/504 |
| 2014/0060960 | A1 * | 3/2014 | Walker | G10K 11/00 181/175 |
| 2014/0116802 | A1 * | 5/2014 | Ma | G10K 11/18 181/286 |
| 2016/0019879 | A1 * | 1/2016 | Daley | G10K 11/04 181/207 |

* cited by examiner

*Primary Examiner* — Jeremy Luks
(74) *Attorney, Agent, or Firm* — Wayne Edward Ramage; Baker Donelson

(57) ABSTRACT

An acoustic lens or diffractive acoustic device, including but not limited to, a sub-wavelength thickness lens or diffuser, comprising an array of Helmholtz resonators (HRs) that provide perfect or near-perfect sound transmission through a rigid barrier. HRs are arranged in a line or an array confined within a waveguide and oriented so that one neck protrudes onto each side of the barrier. Extraordinary acoustic transmission (EAT) occurs when radiation (such as EM or acoustic radiation) incident on the barrier perforated with sub-wavelength holes is transmitted at a rate higher than expected based on the areal coverage fraction of the holes. Transmission is independent of the direction of sound on the barrier and the relative placement of the necks.

13 Claims, 7 Drawing Sheets

ACOUSTIC LENS USING EXTRAORDINARY ACOUSTIC TRANSMISSION

This application claims benefit of and priority to U.S. Provisional Application No. 62/012,376, filed Jun. 15, 2014, by William M. Robertson, and is entitled to that filing date for priority. The specification, figures, appendices, and complete disclosure of U.S. Provisional Application No. 62/012,376 are incorporated herein by specific reference for all purposes.

FIELD OF INVENTION

This invention relates to a diffractive acoustic device based on extraordinary acoustic transmission.

SUMMARY OF INVENTION

In various embodiments, the present invention comprises an acoustic lens or diffractive acoustic device, including but not limited to, a sub-wavelength thickness lens or diffuser, comprising an array of Helmholtz resonators (HRs). Perfect sound transmission through a rigid barrier occurs with an array of one or more HRs confined within a waveguide and oriented so that one neck protrudes onto each side of the barrier. Extraordinary acoustic transmission (EAT) occurs when radiation (such as EM or acoustic radiation) incident on an opaque barrier perforated with sub-wavelength holes is transmitted at a rate higher than expected based on the areal coverage fraction of the holes. In the present invention, the transmission is independent of the direction of sound on the barrier and the relative placement of the necks.

Acoustic lensing and diffractive acoustic devices can be created using the phase characteristics associated with the phenomenon of EAT. In EAT, sound incident on a perforated barrier can be nearly perfectly transmitted (i.e., greater than 97%) in a narrow frequency range even though the area of the perforations is less than 7% of the total barrier area. In one embodiment, the perforations on each side of the barrier comprise the neck openings of a two-neck HR whose volume is within the barrier. The high transmission occurs in a band of frequencies about the resonant frequency of the HR.

Coincident with the high transmission, the phase of the sound undergoes a smooth continuous change as a function of frequency of about $\pi$ radians. The phase characteristics of EAT are used to create an acoustic lens that focuses sound or a diffractive acoustic element that steers the incident acoustic wave in any desired pattern. In several embodiments, such devices use a two-dimensional array of HRs in a barrier.

A lens or diffractive acoustic device of the present invention is designed to work at a specific target wavelength. The phase profile of an acoustic wavefront at this frequency can be modulated as a function of position across the barrier. This spatial modification of the phase of the transmitted wavefront is accomplished by adjusting the HR frequency at each position of the array either above or below the target wavelength frequency. As an example, for a lens the phase delay would be greatest at the center of the array and become progressively smaller away from the center. This arrangement is analogous to a converging optical lens where there is a larger phase delay for the light that goes through the center of the lens, where the glass is thicker, compared to the phase delay at the edges, where the glass is thinner.

Lensing can be achieved with a single HR element, or an array of multiple HRs. Resonators are tuned such that the phase delay is greatest at the center, and gets progressively smaller with distance from the center. Arrays of HRs can be polygonal, linear, or other configurations. In one embodiment, a simple lens is created from a linear array of 7 HRs each spaced by 0.1 m. The lens operates at about 900 Hz in air and the sound comes to a distinct focus at about 0.47 m from the linear array.

In various embodiments, diffractive acoustic elements may be created in a manner similar to the design of diffractive optics. For example, with the definition of a desired target sound distribution in the far field, the phase of each HR element in an array can be determined by an optimization technique, such as, but not limited to, simulated annealing. Once the desired phase values are set, the resonant frequency of each Helmholtz resonator can be adjusted accordingly. The process functions well because the technique permits a continuous variation in the phase in contrast to diffractive optics in which the phase variations are generally quantized (2-level, 4-level, etc.) by the limitations of nanofabrication.

While the above examples have been presented in the context of a single frequency, the invention can operate at a two or more well-separated discrete frequencies. Two or more HRs in parallel do not interfere with each other's operation as long as the frequency separation is sufficiently large. The transmission at each frequency is unaffected by the presence of the second resonator.

The acoustic lens and other devices presented herein may be used in areas such as, but not limited to, sonar and ultrasonics. Advantages of the present invention compared to other techniques are the high throughput and the sub-wavelength thickness of the lens. In contrast, lensing technology based on zone plates loses more than 50% of the incident sound due to reflection and lenses based on modifying the effective velocity using arrays of rods or spheres are all require a thickness greater than a wavelength. Further, the ability to modify the phase profile of the present invention has applications including diffusers for architectural acoustics or sonar applications or the creation of patterned acoustic beams for sonar and ultrasound.

DETAILED DESCRIPTION OF EXEMPLARY EMBODIMENTS

In various exemplary embodiments, the present invention comprises an acoustic lens or diffractive acoustic device, including but not limited to, a sub-wavelength thickness lens or diffuser, comprising an array of Helmholtz resonators (HRs). Perfect or near-perfect sound transmission through a rigid barrier occurs with an array of one or more HRs confined within a waveguide and oriented so that one neck protrudes onto each side of the barrier. Extraordinary acoustic transmission (EAT) occurs when radiation (such as EM or acoustic radiation) incident on an opaque barrier perforated with sub-wavelength holes is transmitted at a rate higher than expected based on the areal coverage fraction of the holes. In the present invention, the transmission is independent of the direction of sound on the barrier and the relative placement of the necks.

Figure 1:
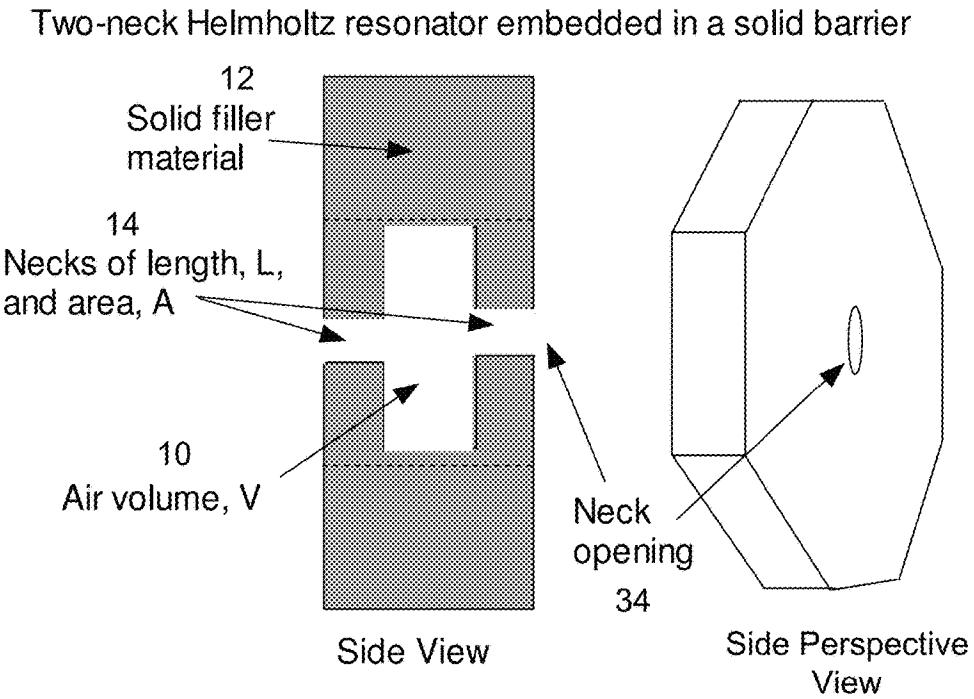
FIG. 1 shows a two-neck Helmholtz resonator embedded in a solid barrier.

Acoustic lensing and diffractive acoustic devices can be created using the phase characteristics associated with the phenomenon of EAT. In EAT, sound incident on a perforated barrier can be nearly perfectly transmitted (i.e., greater than 97%) in a narrow frequency range even though the area of the perforations is less than 7% of the total barrier area. In one embodiment, as seen in FIG. 1, the perforations on each side of the barrier comprise the neck openings of a two-neck HR whose volume is within the barrier. The embedded HR comprises a cavity, volume or space 10 totally embedded or enclosed within a barrier 12, and two necks 14 that project from the cavity through side of the barrier. This HR configuration has a well-defined resonant frequency. The high transmission occurs in a band of frequencies about the resonant frequency of the HR.

Thus, an incident sound wave the resonant frequency of the HR can experience perfect or near-perfect (i.e., greater than 97%) transmission through the barrier, even though the open area created by the neck openings may only be 3% to 8% of the surface area of the surface area of the barrier.

Figure 2:
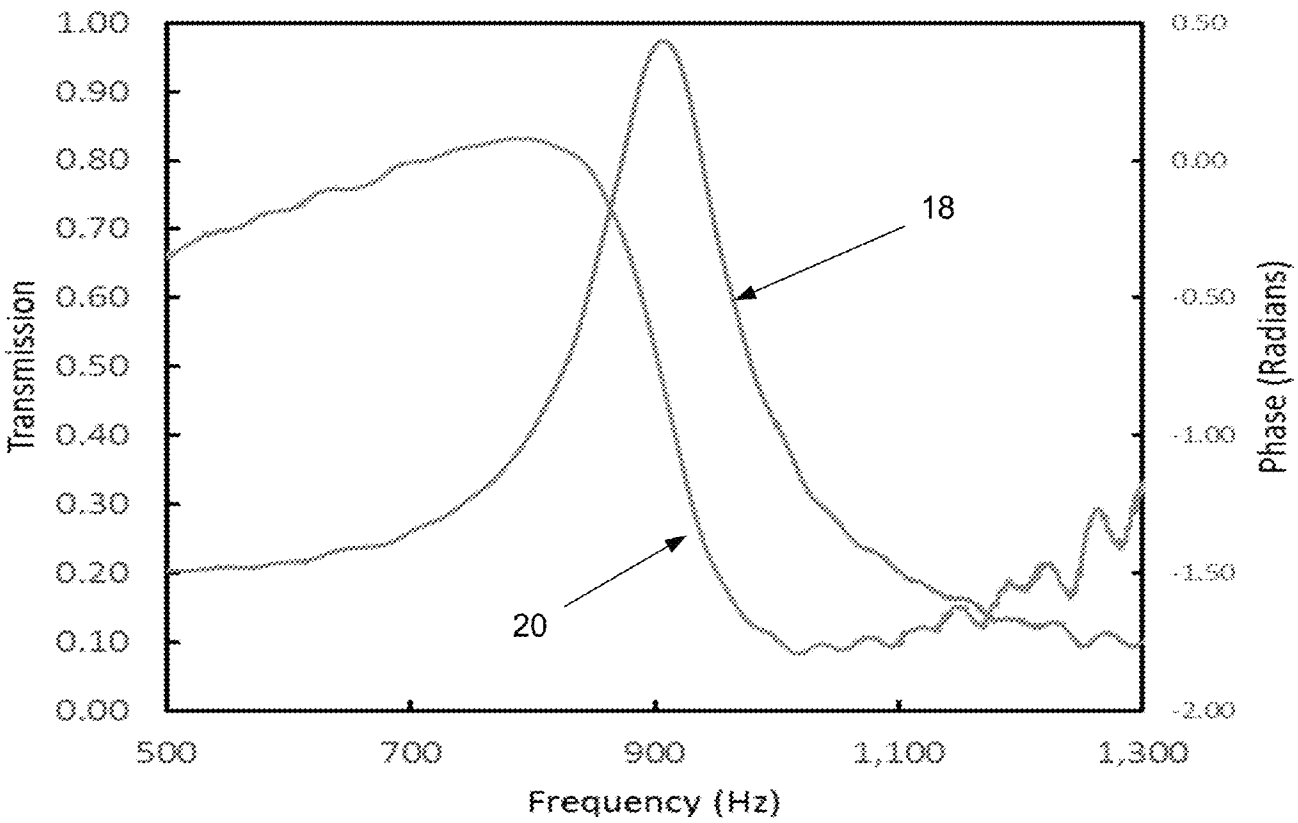
FIG. 2 shows a graph of transmission and phase as a function of frequency of a Helmholtz resonator.

Coincident with the high transmission, the phase of the sound undergoes a smooth continuous change as a function of frequency of about $\pi$ radians, from a frequency just below the resonant frequency to one just above the resonant frequency. The transmission amplitude 18 and phase 20 as a function of sound frequency for an HR with a resonant frequency of 900 Hz is shown in FIG. 2.

Figure 3:
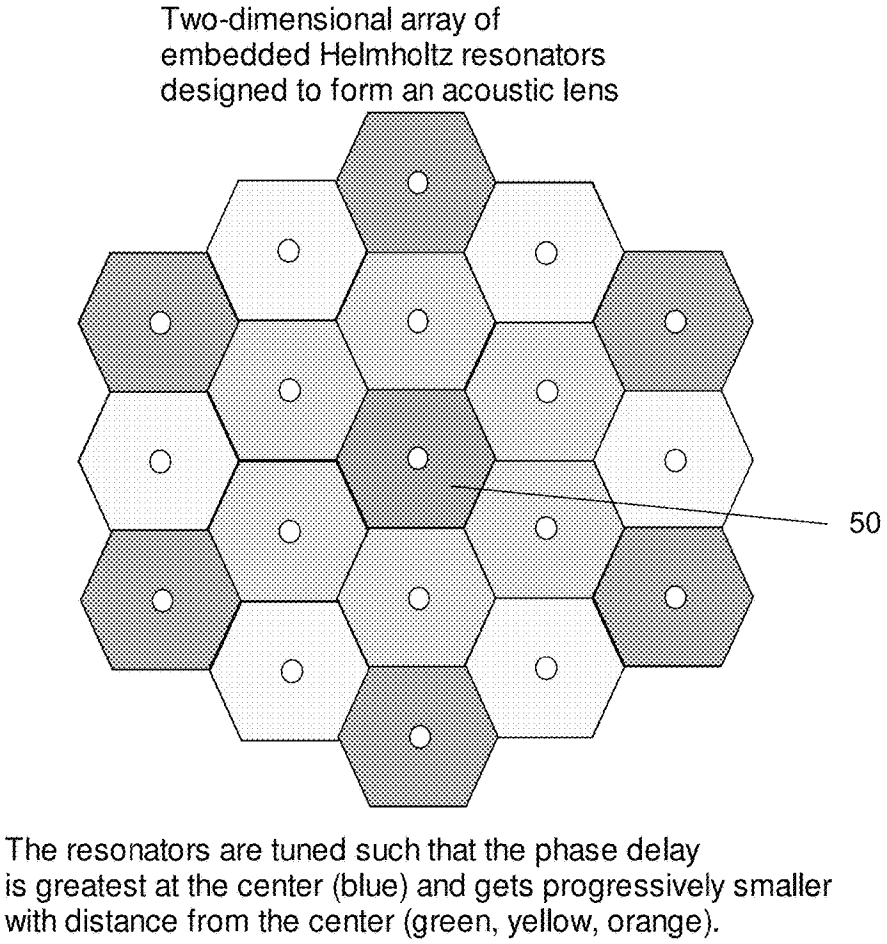
FIG. 3 shows a two-dimensional array of embedded Helmholtz resonators forming an acoustic lens.
Figure 4:
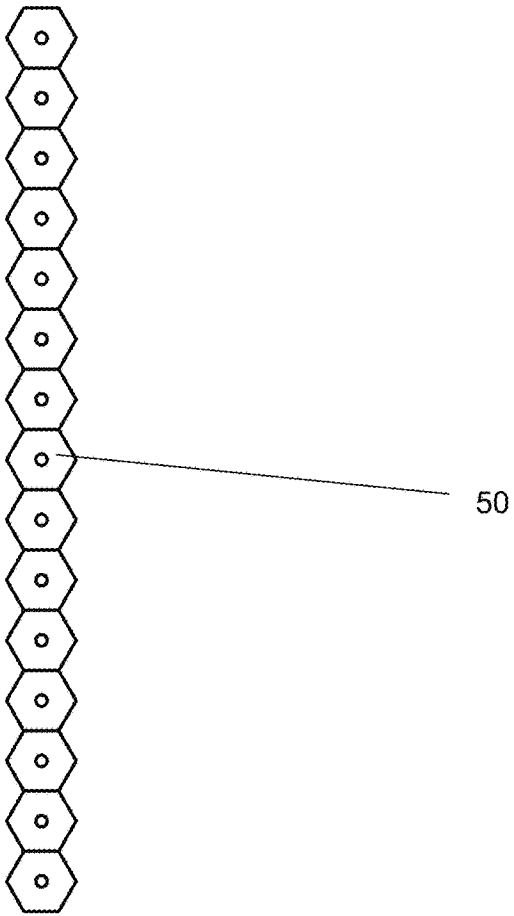
FIG. 4 shows a line of embedded Helmholtz resonators forming an acoustic lens.
Figure 5A:
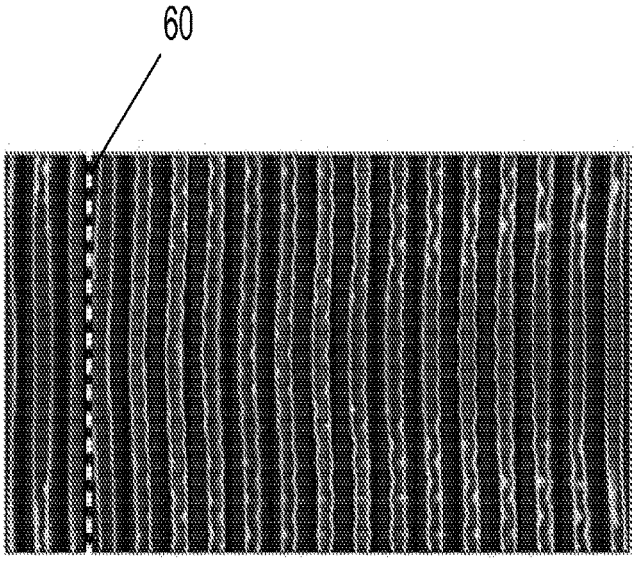
FIGS. 5A and 5B show sound wave amplitude and sound wave intensity plots for a linear array of fifteen Helmholtz resonators.
Figure 5B:
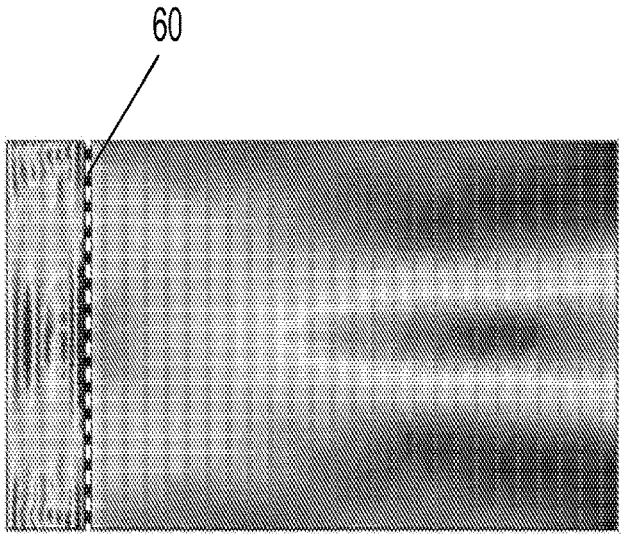

The phase characteristics of EAT are used to create an acoustic lens that focuses sound or a diffractive acoustic element that steers the incident acoustic wave in any desired pattern. In several embodiments, such devices use a one-dimensional line or two-dimensional array of HRs in a barrier, as seen in FIGS. 3 and 4. The line or arrays of HRs embedded in the barrier can spatially modulate the phase of an acoustic wave. This phase modulation can be configured to create a sub-wavelength-thickness acoustic lens or to create a diffractive acoustic element that could steer the transmitted sound wave in any desired direction or pattern. The spatial phase modulation is achieved by tuning the resonant frequencies HRs in the array to be slightly above or below the target operation frequency of the device (i.e., lens or diffractive acoustic element). The simplest example is a lens consisting of a linear array of HRs, as seen in FIG. 4. The phase delay between the center resonator 50 and those successively further away from the center are selected to cause the transmitted wavefront to curve such that the sound wave comes to a focus. FIG. 5A shows the curvature in the wave front amplitude (sound waves are incident from the left), and FIG. 5B shows the focus spot in intensity on transmission through a fifteen-element linear array 60.

In one embodiment, a lens or diffractive acoustic device of the present invention is designed to work at a specific target wavelength. The phase profile of an acoustic wavefront at this frequency can be modulated as a function of position across the barrier. This spatial modification of the phase of the transmitted wavefront is accomplished by adjusting the HR frequency at each position of the array either above or below the target wavelength frequency. As an example, for a lens the phase delay would be greatest at the center of the array and become progressively smaller away from the center. This arrangement is analogous to a converging optical lens where there is a larger phase delay for the light that goes through the center of the lens, where the glass is thicker, compared to the phase delay at the edges, where the glass is thinner.

An example of an array configuration (i.e., multiple HRs) to achieve lensing is shown in FIG. 3. The resonators in FIG. 3 are tuned such that the phase delay is greatest at the center, and gets progressively smaller with distance from the center.

Figure 6:
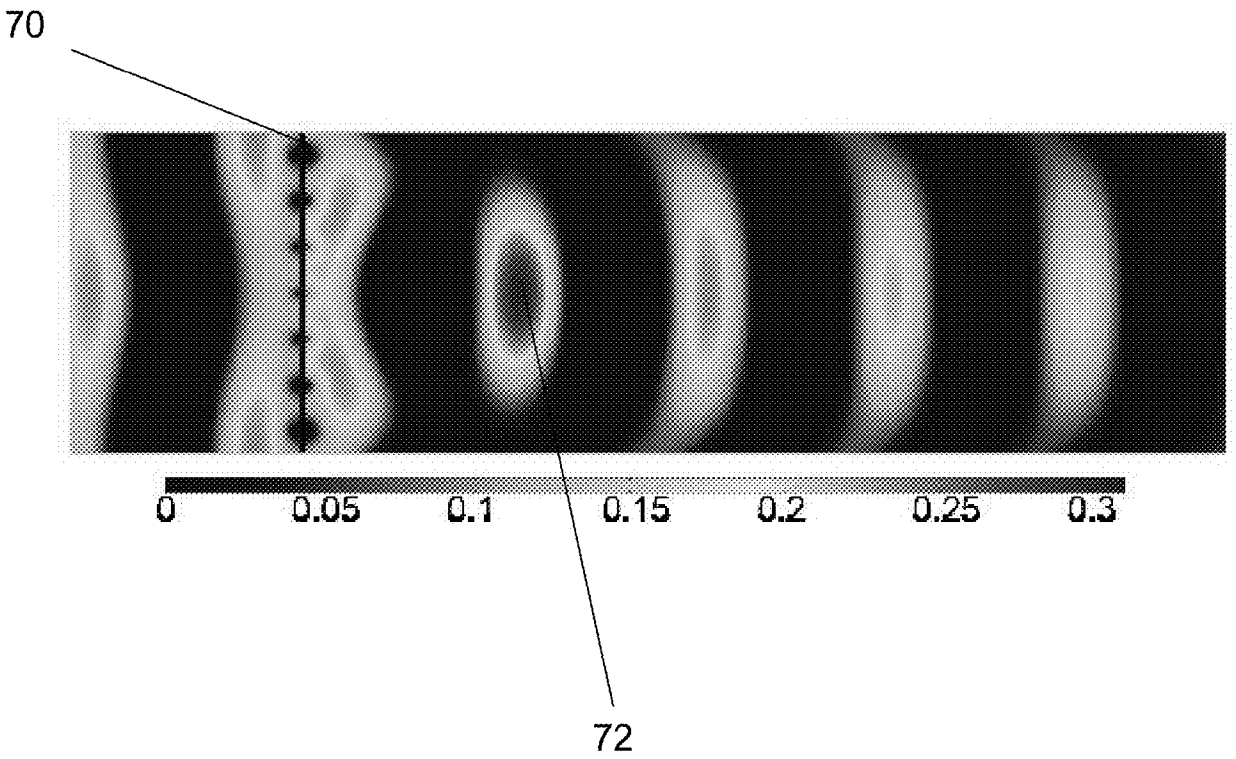
FIG. 6 shows an image of a simple acoustic lens created from a linear array of seven Helmholtz resonators.

Arrays of HRs can be polygonal, linear, or other configurations. A computer image of a simple lens created from a linear array 70 of seven HRs each spaced by 0.1 m is shown in FIG. 6. The lens operates at about 900 Hz in air and the sound comes to a distinct focus 72 at about 0.47 m from the linear array.

In various embodiments, diffractive acoustic elements may be created in a manner similar to the design of diffractive optics. For example, with the definition of a desired target sound distribution in the far field, the phase of each HR element in an array can be determined by an optimization technique, such as, but not limited to, simulated annealing. Once the desired phase values are set, the resonant frequency of each Helmholtz resonator can be adjusted accordingly. The process functions well because the technique permits a continuous variation in the phase in contrast to diffractive optics in which the phase variations are generally quantized (2-level, 4-level, etc.) by the limitations of nanofabrication.

Figure 7:
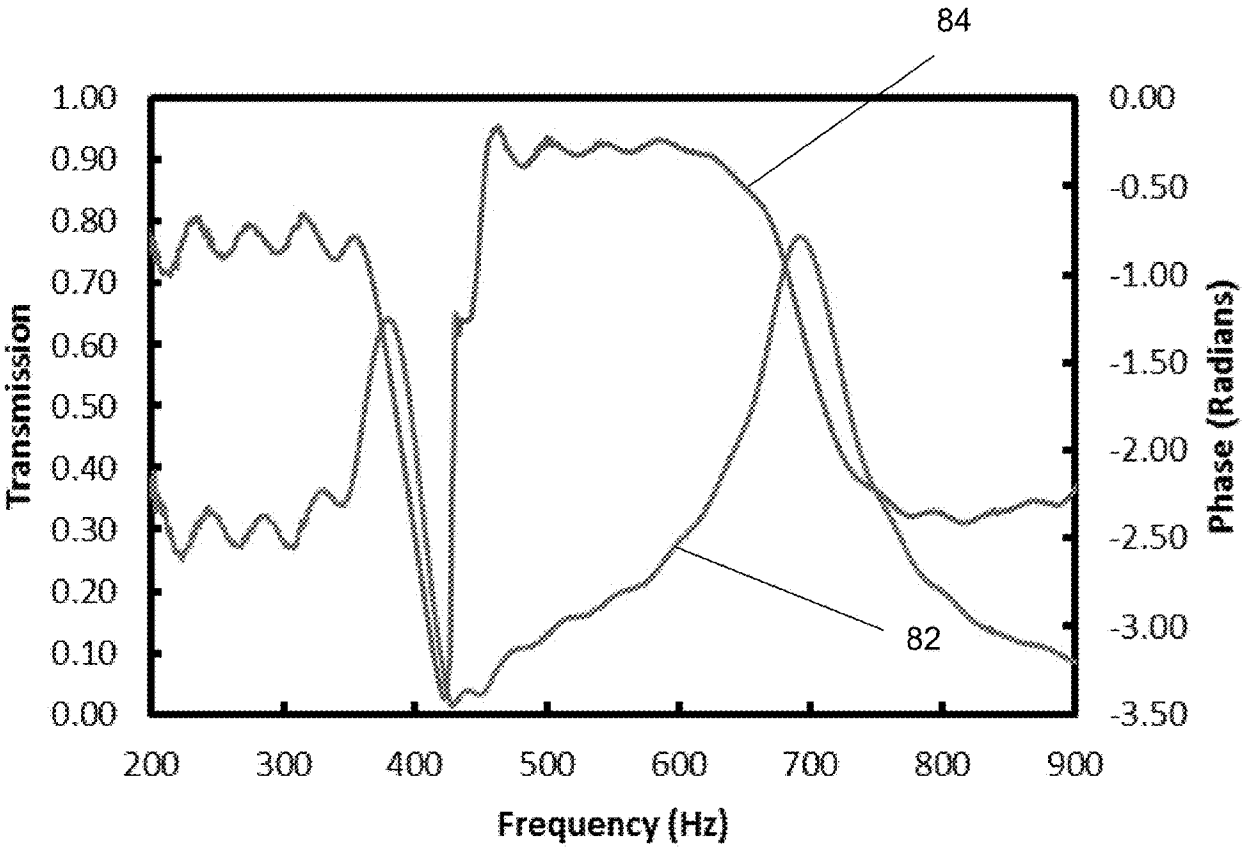
FIG. 7 shows a graph of transmission and phase as a function of frequency for two well-separated Helmholtz resonators.

While the above examples have been presented in the context of a single frequency, the invention can operate at a two or more well-separated discrete frequencies. Two or more HRs in parallel do not interfere with each other's operation as long as the frequency separation is sufficiently large. FIG. 7 shows the transmission 82 and phase 84 as a function of frequency for two well-separated resonators. The transmission at each frequency is unaffected by the presence of the second resonator.

The acoustic lens and other devices presented herein may be used in areas such as, but not limited to, sonar and ultrasonics. Advantages of the present invention compared to other techniques are the high throughput and the planar nature and sub-wavelength thickness of the lens or acoustic element. This is important for the creation of lenses for sonar signals, for example, which can have wavelengths of many meters. In contrast, lensing technology based on zone plates loses more than 50% of the incident sound due to reflection and lenses based on modifying the effective velocity using arrays of rods or spheres are all require a thickness greater than a wavelength.

Further, the ability to modify the phase profile of the present invention has applications including diffusers for architectural acoustics or sonar applications or the creation of patterned acoustic beams for sonar and ultrasound. Because the phase on an acoustic wave front can be continuously modified between 0 and $\pi$ radians by a one- or two-dimensional array of HRs, it is possible to build diffractive acoustics devices that can form the acoustic wave into any desired far field pattern. A simple example would be a diffraction grating of alternating regions of 0 and $\pi$ radian phase shift that sends sound in specific symmetrical diffracted directions. A more complicated example would be to funnel transmitted sound in a single particular direction. For example, a barrier beside a roadway could be designed to send sound up into the air to reduce noise in a neighborhood. A similar design might be used in an architectural setting to channel sound away from certain areas. This application is analogous to diffractive optic devices that can create light in any desired output pattern. A key difference here is that the acoustic HR device can create a continuous phase variation between 0 and $\pi$, whereas most diffractive optic devices are binary in nature being composed of only the two levels 0 and $\pi$.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An device for modifying radiation, comprising:

a plurality of Helmholtz resonators embedded in a barrier with a first side and a second side, each Helmholtz resonator with a resonant frequency, each Helmholtz resonator comprising an embedded air volume with a first neck extending from the air volume to a first opening on the first side of the barrier and a second neck extending from the air volume to a second opening on the second side of the barrier, wherein the first opening and second opening are smaller in diameter than a diameter or width of the air volume;

wherein said barrier is opaque to radiation incident on the first side; and wherein the device transmits the majority of the radiation through the plurality of Helmholtz resonators to the other side of the barrier.

2. The device of claim 1, wherein the acoustic device is an acoustic lens.

3. The device of claim 1, wherein the acoustic device is a diffractive acoustic device or diffuser.

4. The device of claim 1, wherein the radiation is an acoustic or sound wave.

5. The device of claim 1, wherein the thickness of the device is below the incident radiation's wavelength.

6. The device of claim 1, wherein the Helmholtz resonators are configured in a line.

7. The device of claim 1, wherein the Helmholtz resonators are configured in a two-dimensional array.

8. The device of claim 1, wherein the Helmholtz resonators have the same resonant frequency.

9. The device of claim 1, wherein at least one of said Helmholtz resonators has a different resonant frequency from the remaining Helmholtz resonators.

10. The device of claim 1, wherein each Helmholtz resonator has a phase profile.

11. The device of claim 7, wherein the array is configured to spatially modulate the phase of the incident radiation.

12. The device of claim 11, wherein the Helmholtz resonator resonant frequencies are tuned to be slightly above or slightly below a selected operation frequency of the device.

13. The device of claim 10, wherein the Helmholtz resonators are arranged to create a grating with different regions of phase profiles.

* * * * *